US007658886B2

(12) United States Patent
Olivier et al.

(10) Patent No.: US 7,658,886 B2
(45) Date of Patent: Feb. 9, 2010

(54) UNIVERSAL FILTRATION PLATE

(75) Inventors: Stéphane Jean Marie Olivier, Rosheim (FR); Gerard Muller, Urmatt (FR); Jeffrey S. Busnach, Illkirch-graffenstaden (FR)

(73) Assignee: Millipore Corporation, Billerica, MA (US)

( * ) Notice: Subject to any disclaimer, the term of this patent is extended or adjusted under 35 U.S.C. 154(b) by 534 days.

(21) Appl. No.: 10/838,588

(22) Filed: May 4, 2004

(65) Prior Publication Data

US 2004/0247490 A1 Dec. 9, 2004

(51) Int. Cl.
*B01L 1/00* (2006.01)

(52) U.S. Cl. ..... 422/101

(58) Field of Classification Search ..... 422/101; 210/650

See application file for complete search history.

(56) References Cited

U.S. PATENT DOCUMENTS

| | | | | |
|---|---|---|---|---|
| 4,902,481 | A * | 2/1990 | Clark et al. | 422/101 |
| 4,948,442 | A | 8/1990 | Manns | |
| 5,108,704 | A * | 4/1992 | Bowers et al. | 422/101 |
| 5,888,830 | A * | 3/1999 | Mohan et al. | 436/174 |
| 6,048,457 | A | 4/2000 | Kopaciewicz | |
| 6,309,605 | B1 | 10/2001 | Zermani | |
| 6,391,241 | B1 | 5/2002 | Cote | |
| 6,514,463 | B2 | 2/2003 | Zermani | |
| 7,135,117 | B2 * | 11/2006 | Kane | 210/650 |
| 2002/0125197 | A1 * | 9/2002 | Hager et al. | 210/739 |

FOREIGN PATENT DOCUMENTS

| | | | |
|---|---|---|---|
| GB | 2 239 947 | | 7/1991 |
| GB | 2239947 | A * | 7/1991 |
| WO | WO 02/096563 | | 12/2002 |

OTHER PUBLICATIONS

Technical Data on Porex available from www.materialica.com. Date unknown.*

International Search Report, Nov. 2, 2004.

* cited by examiner

*Primary Examiner*—Walter D Griffin
*Assistant Examiner*—Bobby Ramdhanie

(57) ABSTRACT

The present invention relates to a multiwell plate having a series of wells, each well having an inner bore, an open top and a bottom, the bottom being sealed with a liquid permeable filter, and an insert contained within the inner bore of each well, each insert having an outer dimension the same or larger than that of the inner bore and a through bore of a dimension less than that of the outer dimension of the insert. The use of inserts allows one to take a standard one-piece plate design with a heat sealed membrane and arrange for a universal plate format. The insert may act as a base for an extension plate that can be adhered, heat sealed or overmolded over the plate top and insert top to form a deep well plate. The plate conforms to the Society of Biological Standards Microplate Standards. Additionally, the inserts may be configured to give one a different well diameter (smaller, tapered, etc), to include various media such as chromatography resins, to include multiple layers of membrane and the like. A variety of inserts may be used in the same plate to create a minilab on a plate that is capable of conducting several steps of a process on the same (e.g (e.g. filter, wash, bind, elute, label, etc).

29 Claims, 11 Drawing Sheets

UNIVERSAL FILTRATION PLATE

The present invention relates to a multiwell filtration plate. More particularly, it relates to a multiple well filtration plate using inserts to provide various features and functions to the plate.

BACKGROUND OF THE INVENTION

The use of multiwell filtration plates is well established in the life sciences. They have been used among things as microtiter plates, cell growth plates, drug candidate screening tools and high throughput systems for the recovery of DNA, RNA, SEQ products, proteins, peptides and the like.

They all encompass the same basic design features. There is a plate having a series of two or more wells, each well having an open top and a open bottom that is essentially closed in some manner, except for an outlet and a filter positioned at or above the outlet and sealed in a manner such that all fluid to filtered must pass through the filter before reaching the outlet. Typically a collection plate is positioned below the filtration plate to collect the filtrate.

These devices are of a few basic designs.

The first being where the well bottom is open and a filter is sealed across the bottom of the well to make a semipermeable outlet. Often an underdrain is attached below the filter and contains a series of spouts that direct the filtrate into the collection plate. See U.S. Pat. No. 4,902,481.

A second version takes a bottom insert or short plate having a series of two or more wells an open top and an essentially closed bottom except for an outlet and a top plate having a corresponding series of wells having an open top and an open bottom and a filter piece positioned between the two. The two plates are formed together into one integral unit be it by thermal bonding or by injection molding one of the plates to the other. See U.S. Pat. No. 4,948,442 or U.S. Pat. No. 6,391,241.

The third version is to form a single piece multiwell device having a series of two or more wells having an open top and an at least partially to substantially closed bottom and inserting a filter piece into each well and securing it at or near the bottom by a separate ring such as a gasket (See U.S. Pat. No. 5,116,496) or by heat sealing the filter to the bottom of the well (See U.S. Pat. No. 6,309,605).

All of these devices use some type of external pressure to cause the filtration, be it a positive pressure, generated by centrifugation or a positive pressure (higher than atmospheric) applied to the top of the wells or a vacuum applied to the bottom of the wells below the outlet.

These plates have typically been arranged in rows and columns where each row and each column is parallel to the all the other rows or columns respectively and perpendicular to the intervening columns and rows respectively.

SUMMARY OF THE INVENTION

The present invention relates to a multiwell plate having a series of wells, each well having an inner bore, an open top and a bottom, the bottom being sealed with a liquid permeable filter, and an insert contained within the inner bore of each well, each insert having an outer dimension the same or larger than that of the inner bore and a through bore of a dimension less than that of the outer dimension of the insert. The use of inserts allows one to take a standard one piece plate design with a heat sealed or otherwise bonded membrane and arrange for a universal plate format. The insert may act as a base for an extension plate that can be adhered, heat sealed or overmolded over the plate top and insert top to form deeper well plates that can provide appropriate capacities for certain applications. The plate conforms to the Society of Biological Standards Microplate Standards currently in application as an ANSI standard. Additionally, the inserts may be configured to give one a different well diameter (smaller, tapered, etc), to include various media such as chromatography resins, to include multiple layers of membrane, to control the sample volume to membrane and/or plastic surface area ratio, to control the liquid column height to volume ratio, and the like. A variety of inserts may be used in the same plate to create a minilab or diagnostic tool on a plate that is capable of sequentially or non-sequentially conducting several steps of a process on the same plate (e.g. filter, wash, bind, elute, label, etc). The insert itself may act as an active component or surface that plays a principal or secondary role in the process (i.e. be coated, have material mixed or molded directly into it) or on the contrary be particularly inert to reduce non-specific effects such as non-specific binding of proteins to the device surfaces.

It is an object of the present invention to provide a filtration device formed of a filtration plate containing two or more wells, each well having an open top and an essentially closed bottom forming an outlet to the well, each well having an inner bore formed of one or more sidewalls and a bottom surface and a filter permanently sealed to the bottom surface of each well and an insert fit into the inner bore of each well, said insert having an outer dimension substantially the same or in some cases slightly larger than that of the inner bore dimension, a height substantially the same as the inner bore depth above the filter and having a through bore of a dimension less than that of the inner bore of the well, the through bore having an open top and open bottom.

It is another object of the present invention to provide a filtration device having a plurality of wells and an insert contained within each of the wells and an extension plate formed above the filtration plate, the extension plate containing a series of wells equal in number and corresponding in position to the plurality of wells of the filtration plate.

It is a further object of the present invention to provide a filtration device comprising a filtration plate containing two or more wells, each well having an open top and an essentially closed bottom forming an outlet to the well, each well having an inner bore formed of one or more sidewalls and a bottom surface and an insert fit into the inner bore of each well, said insert having an outer dimension substantially the same or bigger than that of the inner bore dimension, a height substantially the same as the inner bore depth above the filter and having a through bore of a dimension less than that of the inner bore of the well, the through bore having an open top and open bottom and a filter permanently sealed to a surface of each insert.

It is an additional object of the present invention to provide a filtration device comprising a filtration plate containing two or more wells, each well having an open top and an essentially closed bottom forming an outlet to the well, each well having an inner bore formed of one or more sidewalls and a bottom surface and an insert fit into the inner bore of each well, said insert having an outer dimension substantially the same or bigger than that of the inner bore dimension, a height substantially the same as the inner bore depth above the filter and having a through bore of a dimension less than that of the inner bore of the well, the through bore having an open top and open bottom and a filter permanently sealed to the bottom surface of each insert.

It is another object of the present invention to provide a process of forming a multiwell filtration device comprising forming a filtration plate containing two or more wells, each well having an open top and an essentially closed bottom forming an outlet to each well, each well having an inner bore formed of one or more sidewalls and the bottom surface, inserting a filter into each well and sealing the filter to the bottom of each well with a process selected from the group consisting of heat bonding, vibration welding and adhesives, inserting an insert into the inner bore of each well, said insert having an outer dimension substantially the same as that of the inner bore dimension, a height substantially the same as the inner bore depth above the filter and having a through bore of a dimension less than that of the inner bore of the well and the through bore having an open top and open bottom.

It is another object of the present invention to provide a process of forming a multiwell filtration device comprising forming a filtration plate containing two or more wells, each well having an open top and an essentially closed bottom forming an outlet to each well, each well having an inner bore formed of one or more sidewalls and the bottom surface, inserting a filter into each well and sealing the filter to the bottom of each well with a process selected from the group consisting of heat bonding, vibration welding and adhesives, inserting an insert into the inner bore of each well, said insert having an outer dimension substantially the same or larger than that of the inner bore dimension, a height substantially the same as the inner bore depth above the filter and having a through bore of a dimension less than that of the inner bore of the well, the through bore having an open top and open bottom and forming an extension plate on top of the filtration plate, the extension plate containing a series of two or more wells equal in number and corresponding in position to the two or more wells of the filtration plate.

It is another object of the present invention to provide a process of forming a multiwell filtration device comprising forming a filtration plate containing two or more wells, each well having an open top and an essentially closed bottom forming an outlet to each well, each well having an inner bore formed of one or more sidewalls and the bottom surface, selecting an insert, sealing a filter to the bottom of the insert with a process selected from the group consisting of heat bonding, vibration welding and adhesives, inserting an insert into the inner bore of each well, said insert having an outer dimension substantially the same or larger than that of the inner bore dimension, a height substantially the same as the inner bore depth above the filter and having a through bore of a dimension less than that of the inner bore of the well, the through bore having an open top and open bottom and forming an extension plate on top of the filtration plate, the extension plate containing a series of two or more wells equal in number and corresponding in position to the two or more wells of the filtration plate.

It is a further object to provide the process of forming a filtration plate having a plurality of wells, fitting inserts within those wells and forming an extension plate containing a plurality of wells equal in number and corresponding in position to the plurality of wells of the filtration plate and thermally bonding the extension plate to the filtration plate.

It is an additional object to provide the process of forming a filtration plate having a plurality of wells, fitting inserts within those wells and forming an extension plate containing a plurality of wells equal in number and corresponding in position to the plurality of wells of the filtration plate by overmolding the extension plate to the filtration plate.

IN THE DRAWINGS

DETAILED DESCRIPTION

The present invention relates to a multiwell plate that has universal application. It may be formed of two or more wells, typically 24, 48, 96, 384 or 1536. The wells are typically arranged in uniform rows and columns (such as 8 by 12 for a 96 well plate design) although this is not a requirement of the invention.

Figure 1:
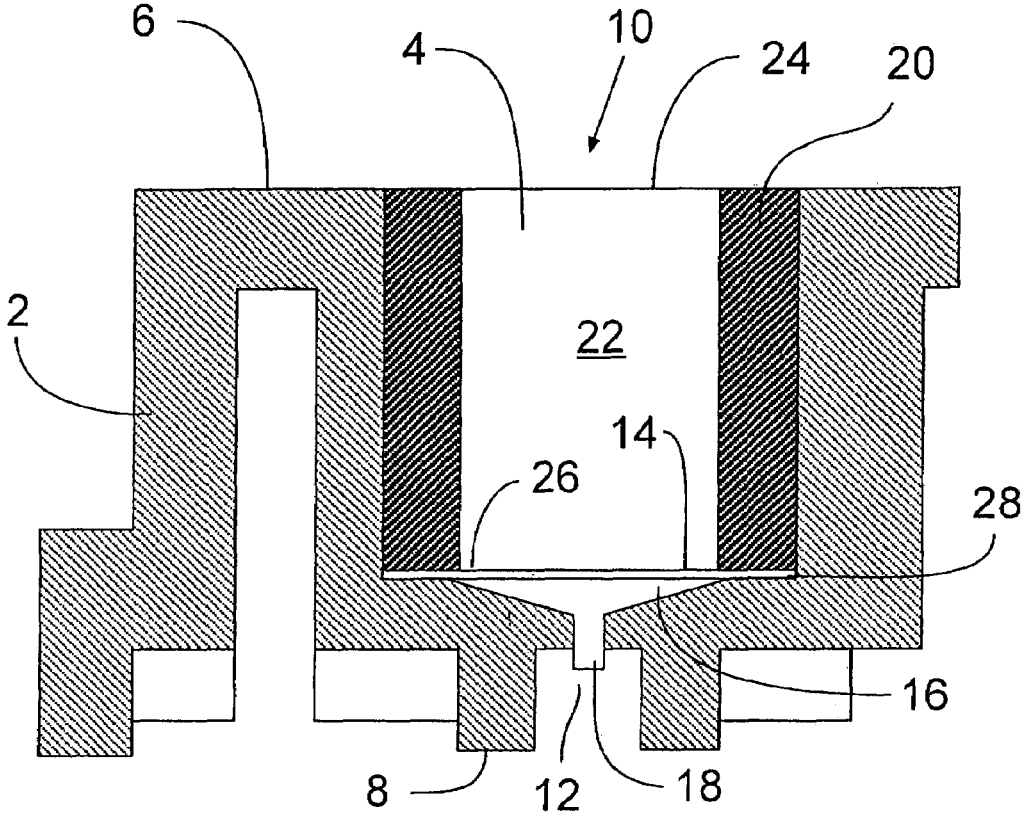
FIG. 1 shows a first embodiment of the present invention in partial cross-sectional view.

The invention is comprised of three basic elements, a well plate having a plurality of wells, a filter element and an insert. FIG. 1 shows the present invention. The well plate 2 contains a series of wells 4, a top surface 6 and a bottom surface 8. The wells 4 have an open top 10 and an essentially closed bottom 12. A filter 14 is sealed across the bottom of each well 4. As shown, the bottom 12 has a tapered portion 16 for collecting filtrate and directing it to the outlet 18 in this instance in the form of spout. To this point, the device is similar in shape and design to that of conventional filtration plates such as is shown in U.S. Pat. Nos. 6,309,605 and 6,514,463.

Figure 1A:
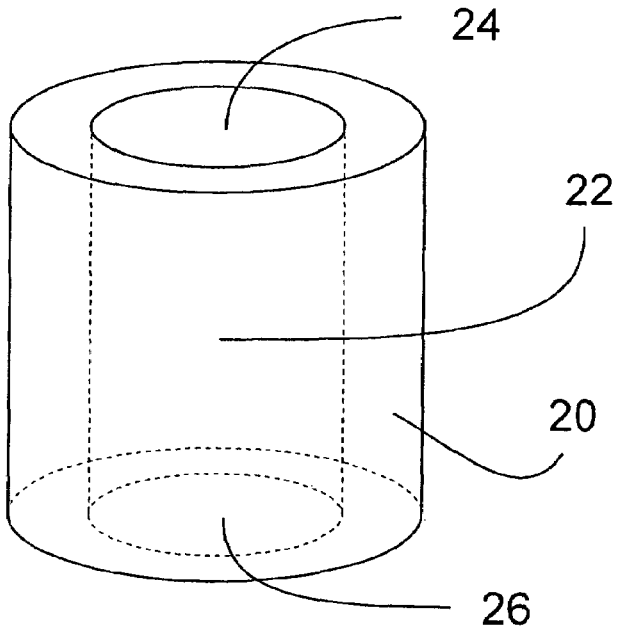
FIG. 1A shows the insert of FIG. 1 in cross sectional view.

The wells 4 contain an insert 20. The insert has an outer dimension substantially the same or larger than that of the inner diameter of the well and a height substantially the same as the inner height of the well from the inner bottom surface to the top plate surface. The insert has a through bore 22 of a dimension less than that of the inner bore of the well, the through bore 22 having an open top 24 and open bottom 26 as shown in FIG. 1A. This insert is placed in the wells 4 over the filter 14. Preferably the insert is dimensioned slightly larger in diameter than the inner bore of the well such that it forms a friction fit with the inner surface of the well walls. Alternatively, the insert may be adhered by an adhesive to the inner wall of the wells. Or it may be solvent bonded to the wall. Another embodiment uses heat or vibration to bond the insert outer surface to the inner wall of the well. Other means may also be used as are known in the art. The intent is to be sure that the insert does not either fall out of the device or create a space into which a sample to be filtered may be retained and removed from the filtration creating a hold up volume that is generally unacceptable.

The inside diameter of each well may be either the same as that of a conventional plate, typically 7 mm in diameter or it may be made slightly larger, such as 8.2 mm in diameter so that the inner diameter of the bore corresponds to that of the conventional plate. Additionally, the well inner diameter may be greater than that normally used but the inner bore of the insert may deliberately be made smaller than the normal diameter of a well. One advantage of using this design is that one may precisely control of the volume to surface area ratios of the resultant test well. This allows one to minimize the use of a precious or scarce chemical, such as a drug candidate by limiting the amount of volume in the well. Likewise, one can limit the amount of chromatography media in the well by selecting a smaller inner bore configuration. Due to the small sample volume normally processed through such a device, most of the media is not used in the process. The present invention provides a means for providing more than enough media capacity for the application at hand without undue waste of the media or creating excess hold up volume of the sample in the column.

The insert 20 may contact the filter 14 and may if desired slightly compress the outer the edge of the filter, but the filter has already been sealed to the well structure to form a liquid impermeable seal. The contact of the insert 20 to the filter 14 does not enhance the seal but merely eliminates any dead area in the device by covering over the portion 28 of the filter 14 that is sealed to the device.

Figure 1B:
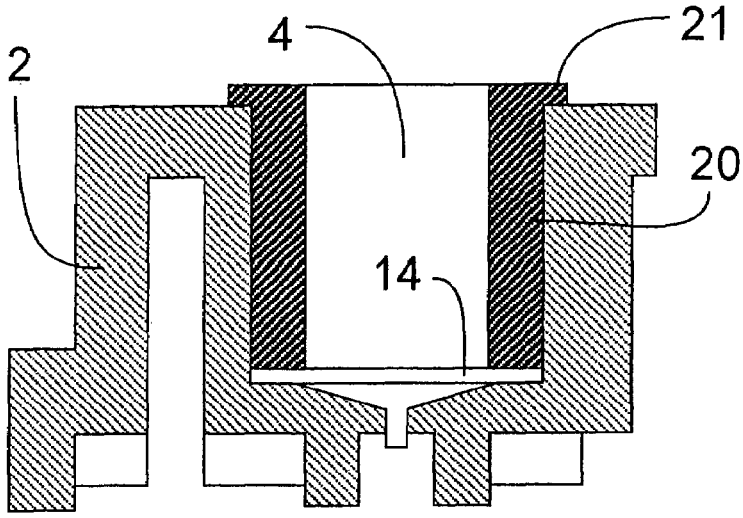
FIG. 1B shows an alternative insert design of the present invention in cross sectional view.

The insert of FIG. 1B shows an alternative arrangement in which the upper portion of the insert 20 has a shoulder 21 that sits on the top surface 6 of the plate 2. This limits the travel of the insert into the well avoiding overcompression of the filter and/or prefilter that may be contained within the well.

Figure 2:
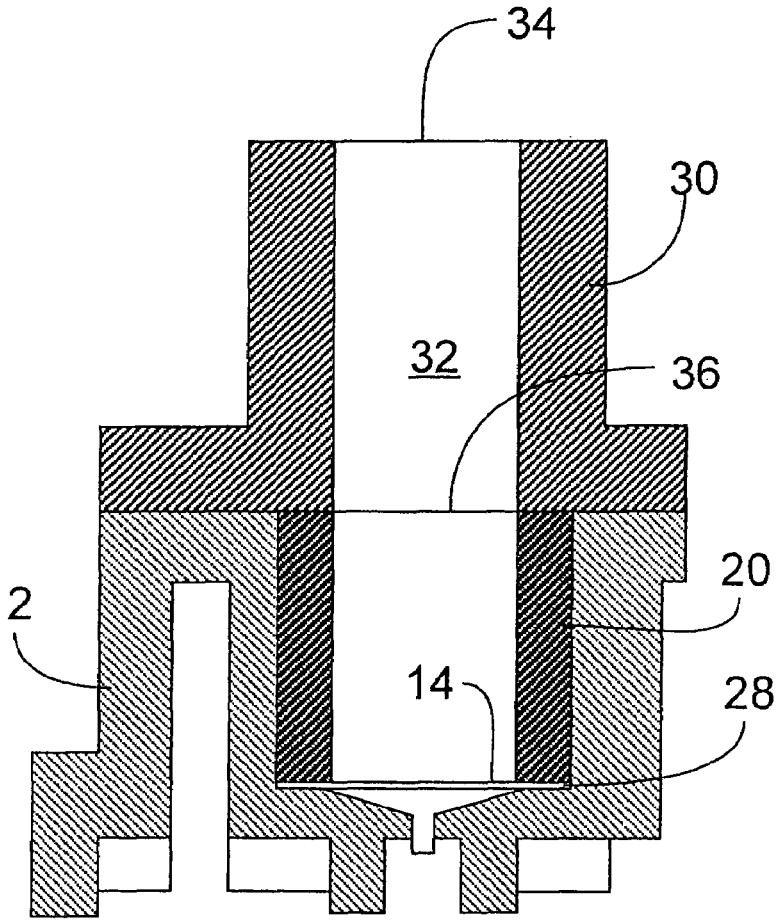
FIG. 2 shows a second embodiment of the present invention in partial cross-sectional view.

FIG. 2 shows a second embodiment of the present invention. To the extent that the same features are used, they retain the same reference number and meaning as in FIG. 1. The embodiment of FIG. 2 adds an extension plate 30 on top of the top surface of the well plate 2. This extension plate is formed of a series of wells 32 having an open top 34 and an open bottom 36. The wells 32 of the extension plate 30 correspond in number and position to those of the well plate 2 below it. The wells 32 have a height preferably equal to or greater than that of the wells 4 below them in the well plate 2 and in combination with the wells 4 of the well plate 2 form a deep plate design that holds additional volume of liquid to be filtered. This design allows one to form a deep well plate while having a filter 14 integrally sealed to the bottom of the well 4. Previous designs such as a one piece deep well device required that the filter be placed into the deep well and then carefully positioned and aligned in that deep well and then be sealed in place. This was often a difficult task. The present invention allows one to seal the filter 14 in a normal plate design and then to form the extension well 32 over it. Additionally, by the use of the insert 20, one has a large and stabile area to which the extension plate 30 can be attached.

Figure 3A:
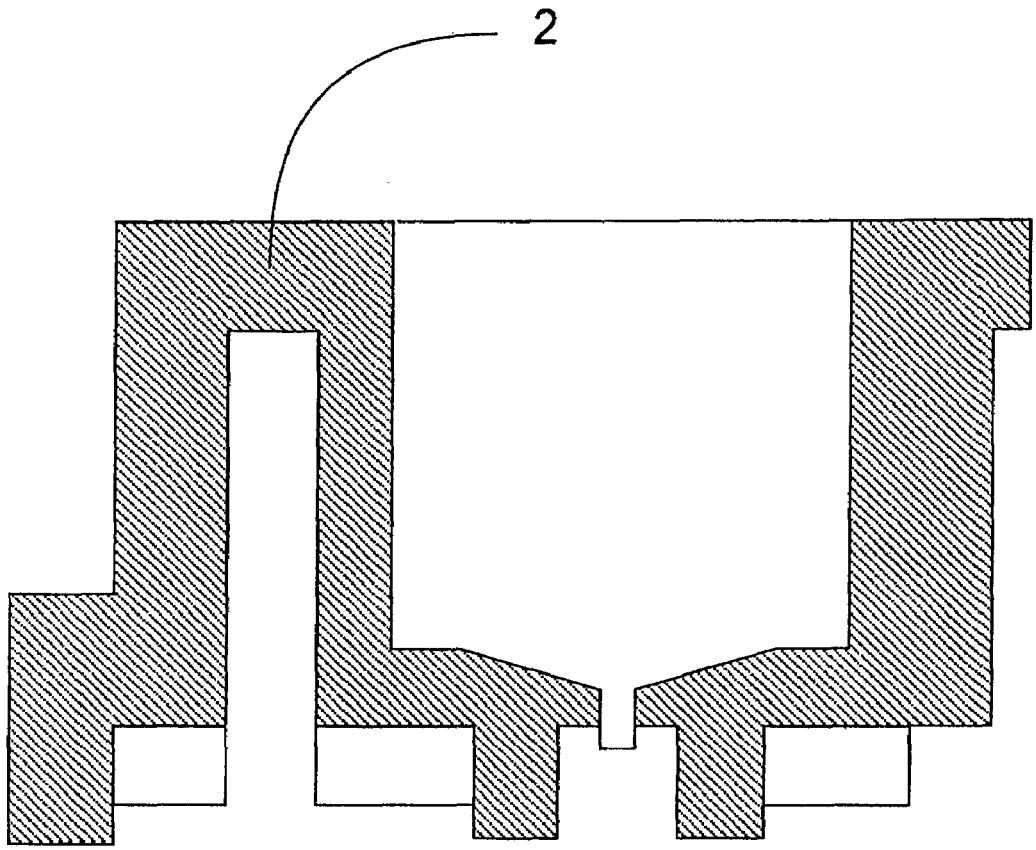
FIGS. 3A-3D shows the embodiment of FIG. 2 of the present invention in partial cross-sectional view as it is being made.
Figure 3B:
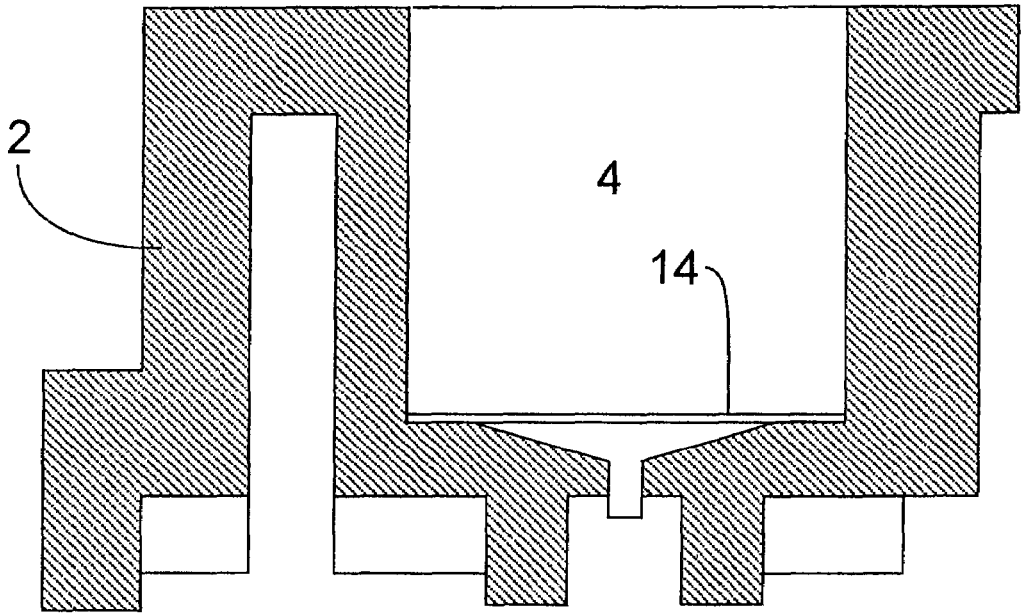
Figure 3C:
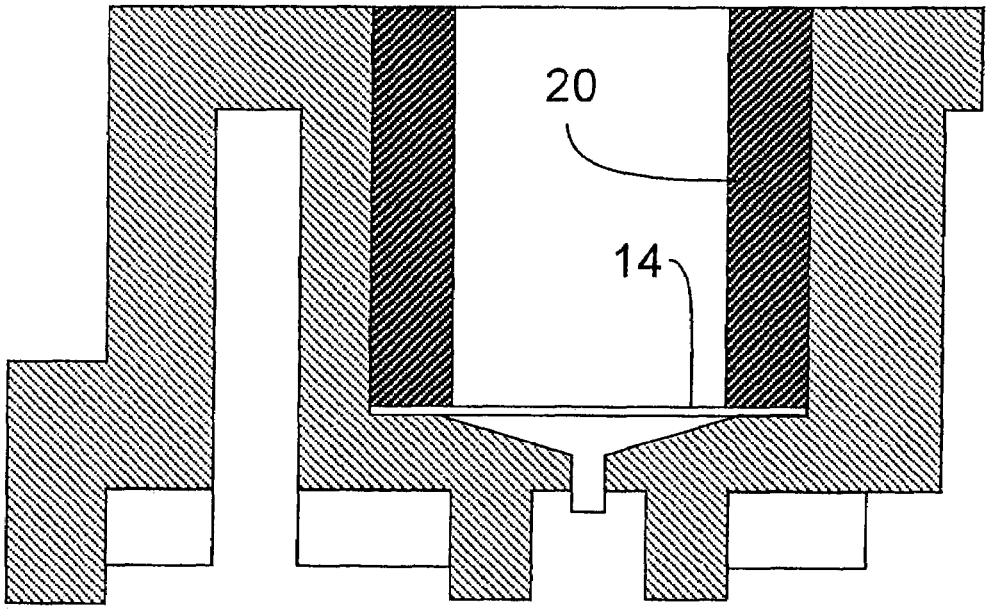
Figure 3D:
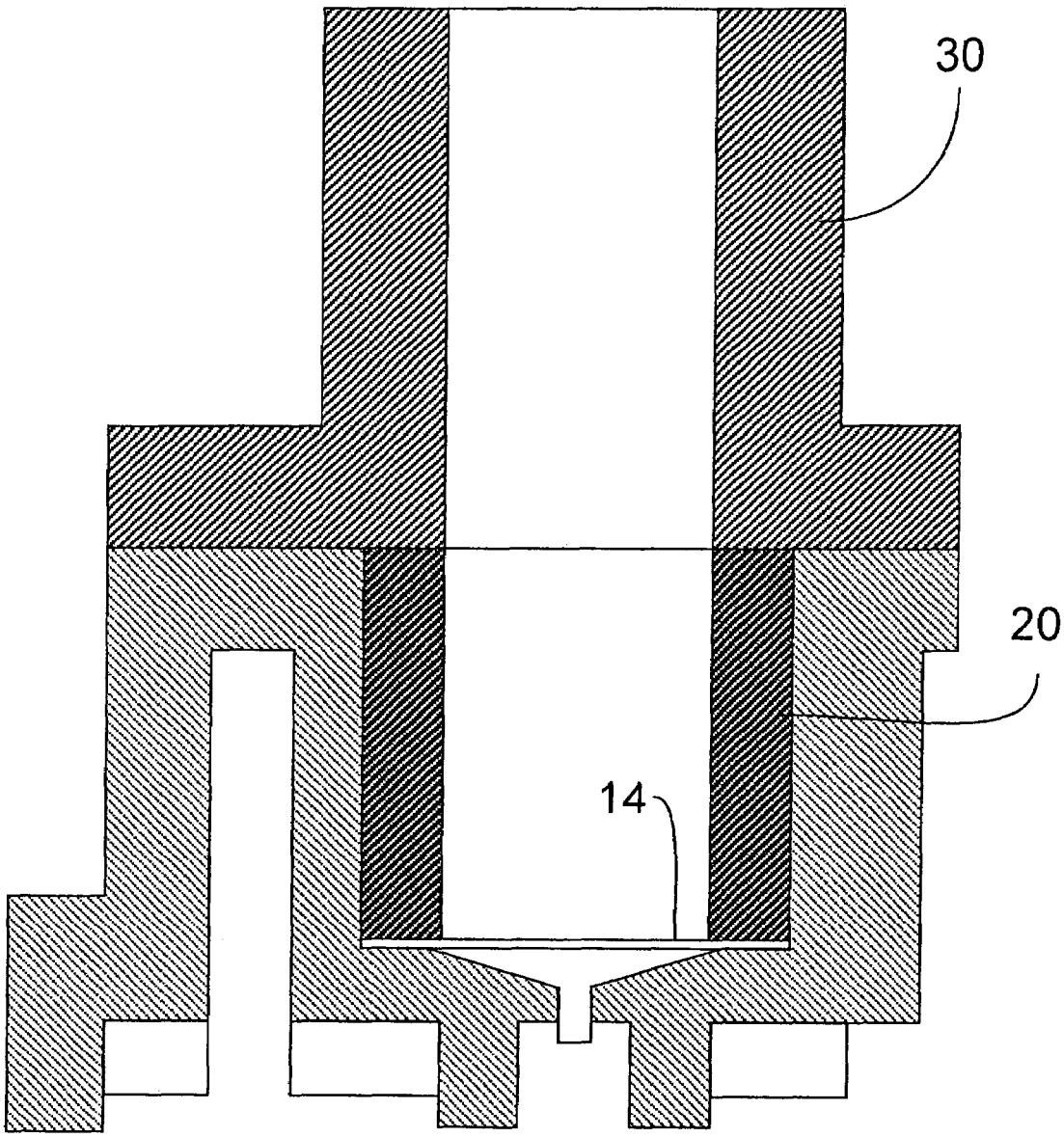

FIGS. 3A-3D show the device in FIG. 2 as it is being made. FIG. 3A shows the well plate 2 before any filter is inserted. FIG. 3B shows the filter 14 having been attached to the bottom of the well 4. In the next step FIG. 3C, the insert 20 is fit into the well over the filter 14 and secured in place. Finally, in FIG. 3D the extension plate 30 is attached to the top surface of the well plate 2.

Figure 4:
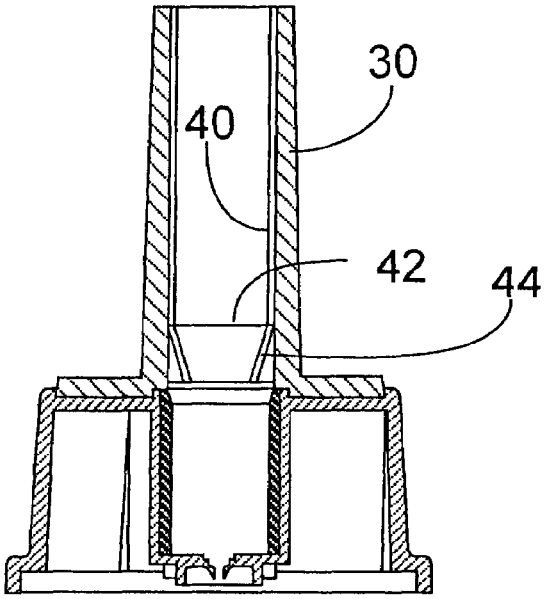
FIG. 4 shows an alternative design to the embodiment of FIG. 2 in partial cross-sectional view.

FIG. 4 shows an alternative design to that of FIG. 2. In this design, the inner walls 40 of the extension plate 30 near its bottom 42 taper inward 44 in order to provide the advantage of containing a large volume of sample. The square well design at the top merges into the circular well design of the plate (as is most common in such plates) and avoids issues that might be presented with sealing two disparate shapes together or with the creation of dead space in which sample can be lost.

Figure 5:
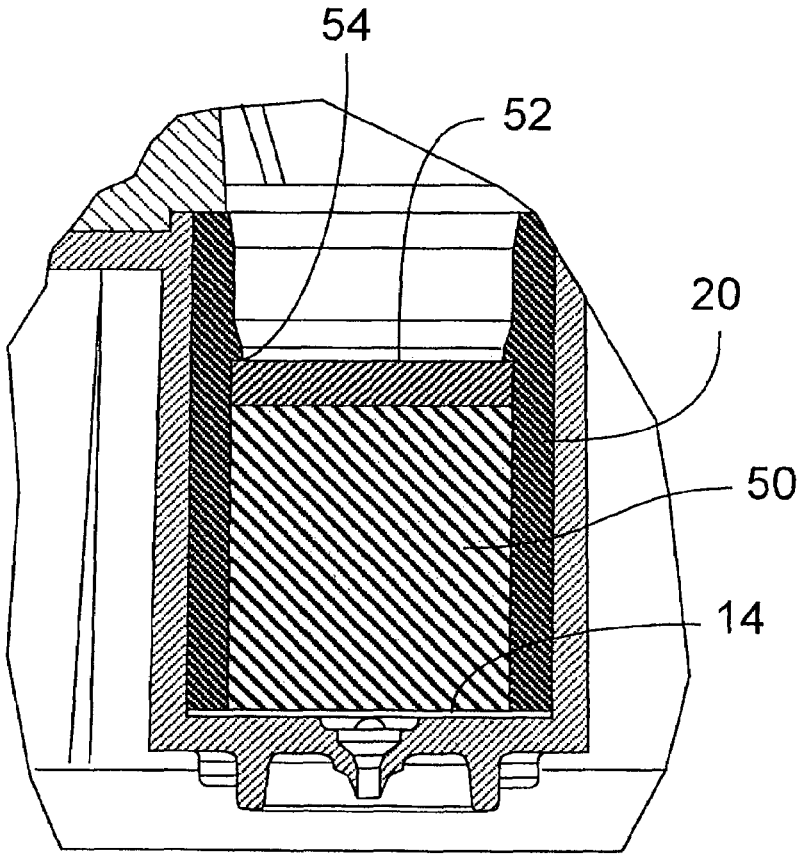
FIG. 5 shows another embodiment of the present invention in partial cross-sectional view.

FIG. 5 shows an embodiment that can be used with that of FIGS. 1,2 or 4 in which media 50 such as chromatography media may be incorporated into the wells of the device. As shown the through bore of the insert is filled with one or more types of media and a frit 52 such as sintered glass or plastic, especially sintered polyethylene or a macroporous structure such as a large pored plastic or a screen is placed or preferably retained by a mechanical device such as the undercut 54 shown in the Figure or by sealing the frit to the inner surface of the through bore. Alternatively, this type of media may be directly incorporated onto the inner surface of the insert in cases where high-specificity or capacity, eliminate or make the use of a large media column undesirable.

Figure 6:
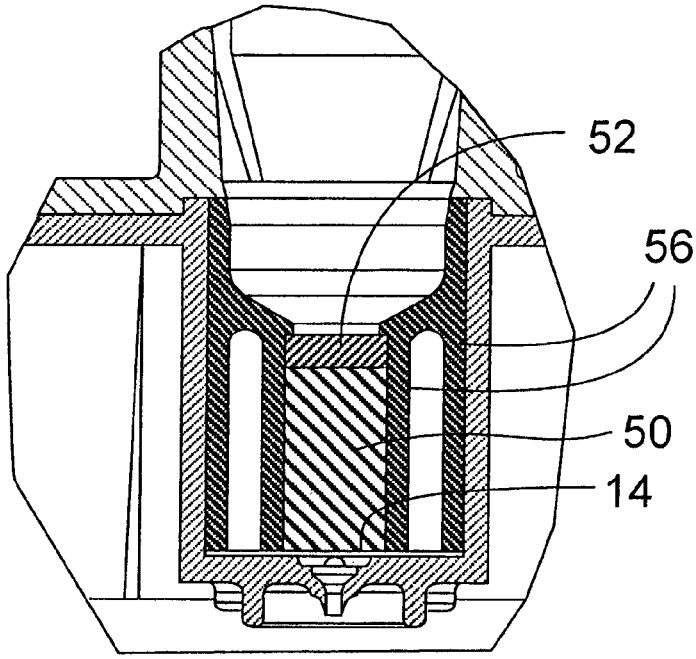
FIG. 6 shows a further embodiment of the present invention in partial cross-sectional view.

FIG. 6 shows an alternative embodiment to that of FIG. 5 in which the amount of media 50 used is less. This is done by forming the inner walls of the through bore closer together. This may be done as shown by a simple molding technique as shown to form a double wall, each of the same relative thickness and a space between them equal to the difference between the inner diameter and outer diameter and the two walls 56. Alternatively, a thicker through bore wall may be used to accomplish the same result.

Figure 7:
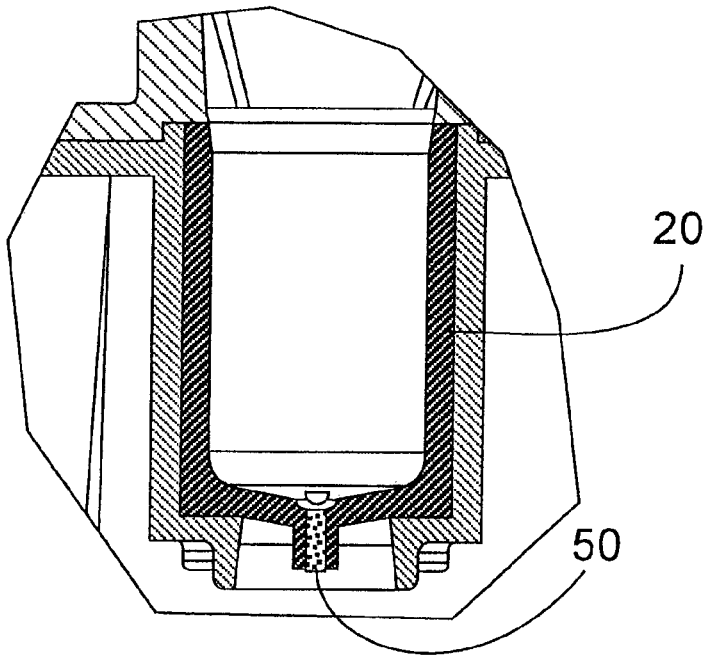
FIG. 7 shows an additional embodiment of the present invention in partial cross-sectional view.

FIG. 7 shows a further embodiment where the media 50 is cast in place in a porous matrix within the outlet and/or a portion of the insert and/or well. Preferably it cast in the outlet region only. This can be done according to the teachings of U.S. Pat. No. 6,048,457 in which a plastic material such as polyvinyl esters, styrene, cellulosic derivatives such as nitrocellulose or regenerated cellulose, PES, PVDF, nylons and the like are solvated in a suitable solvent such as dimethylsulfoxide, dimethylformaide, dimethylacetamide, formamide, formic acid, acetic acid, 2,2,2-trichloro ethanol or mixtures thereof. Media is mixed into the dissolved plastic and is placed, typically by a pipette, into the selected position such as the outlet as shown. The cast solution is then subjected to a precipitation wash in a nonsolvent such as water, alcohols, ammonia, ethylacetate, acetone and the like, either from the bottom of the outlet or from both the top and bottom of the outlet which causes the plastic to gel and form a porous cast in place structure.

In a further alternative to any of the embodiments of FIGS. 1-6, one can seal the filter to the bottom surface of the insert rather than to the bottom inner surface of the well if desired. Again it may be sealed by heat, vibration, solvents or adhesives with heat and vibration being preferred as they do not have any residual solvent or uncured adhesive which may adversely affect the tests carries out in the well.

Figure 8:
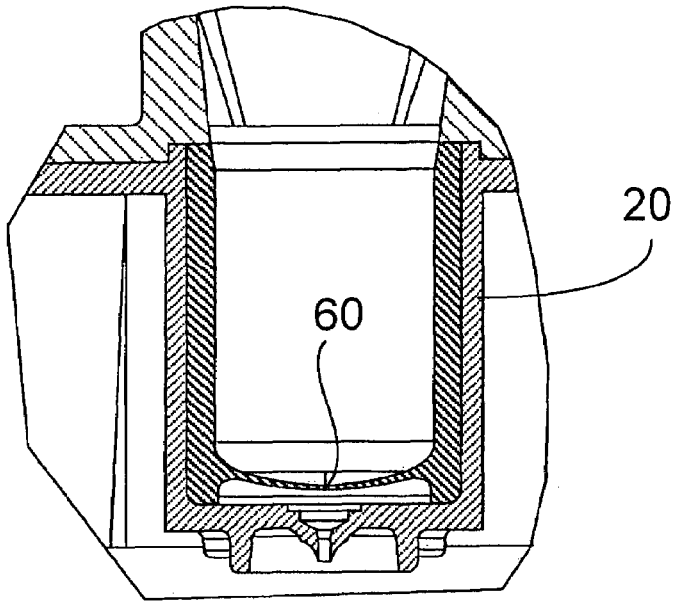
FIG. 8 shows another embodiment of the present invention in partial cross-sectional view.

FIG. 8 shows another embodiment of the present invention in which a valve 60 is located in the bottom of the insert 20. It may be integrally formed as part of the insert as shown such as by forming the insert of a flexible material such as a rubber or elastomeric plastic or it may be separately formed and inserted into the insert 20 or bonded into the inside of the insert. The valve is a simple X cut in the solid substrate that deforms and opens up when a certain pressure is applied to it.

Figure 9:
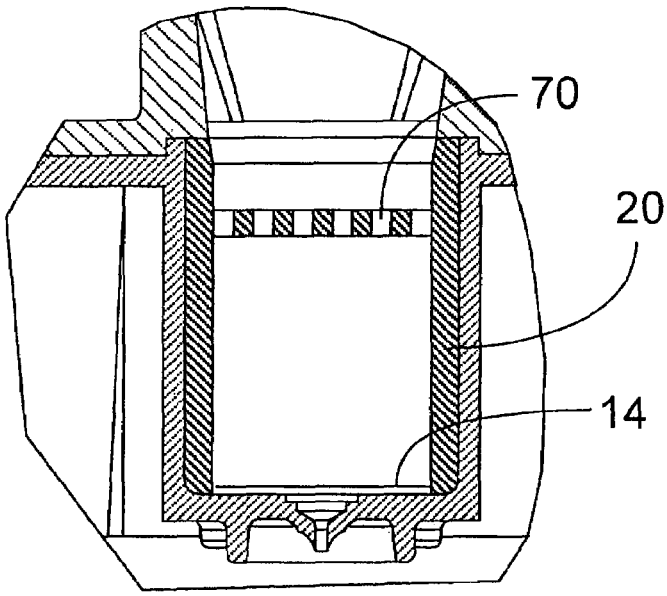
FIG. 9 shows a further embodiment of the present invention in partial cross-sectional view.

FIG. 9 shows another embodiment in which a second filter 70 or screen is located above the filter in the insert to remove any large debris such as cell walls, whole cells, undissolved solids, bead fragments, and the like that might otherwise prematurely clog the filter. It has a larger pore size than the filter below it so as to allow most of the components of the sample to pass through to the first filter. As shown the second filter 70 is located substantially above the first filter. However this is not necessary in all applications.

Figure 10:
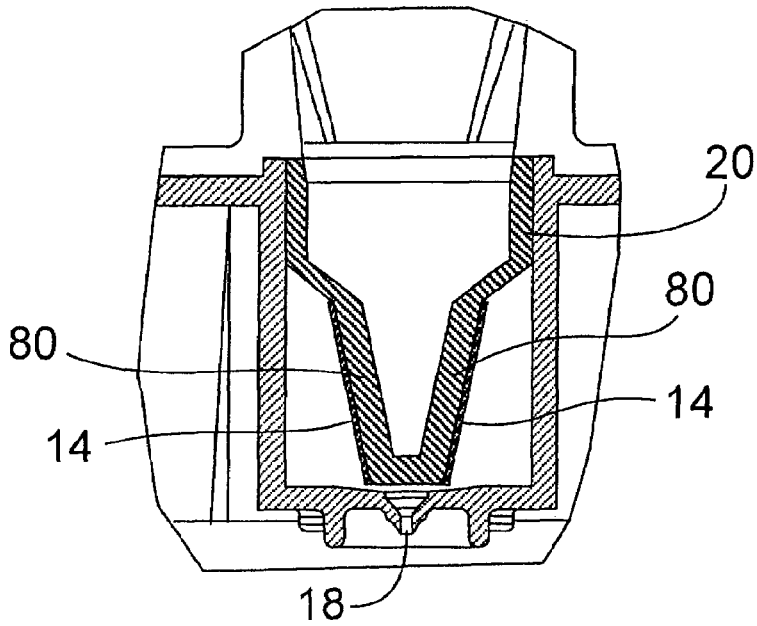
FIGS. 10 and 10A shows a further embodiment of the present invention in partial cross-sectional view.
Figure 10A:
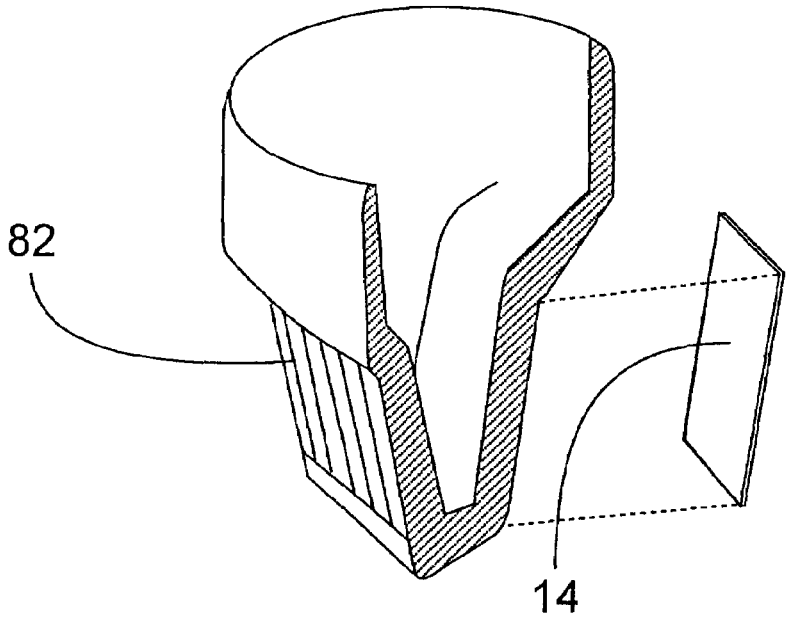

In FIGS. 10 and 10A, another embodiment is shown. FIG. 10 shows the insert in the well plate. FIG. 10A shows just the insert. In this embodiment, the filter is not sealed to the bottom of the well but rather to the insert 20. The insert 20 is formed with two tapered, flat surfaces 80 that have a series of holes or slots 82 (FIG. 10A) formed in them so as to allow fluid from the interior of the through bore to pass through to the exterior of the insert and then to the outlet of the well. A piece of filter 14 is placed and sealed over each of the flat surfaces 80 so that all fluid from the interior of the insert 20 passes through the holes 82 and the filter 14 on each side of the insert 20 before reaching the outlet 18. This provides one with enhanced filtration especially when subjected to centrifugation, as the filter area is substantially greater than what can be placed in the bottom of a well 4.

Figure 11:
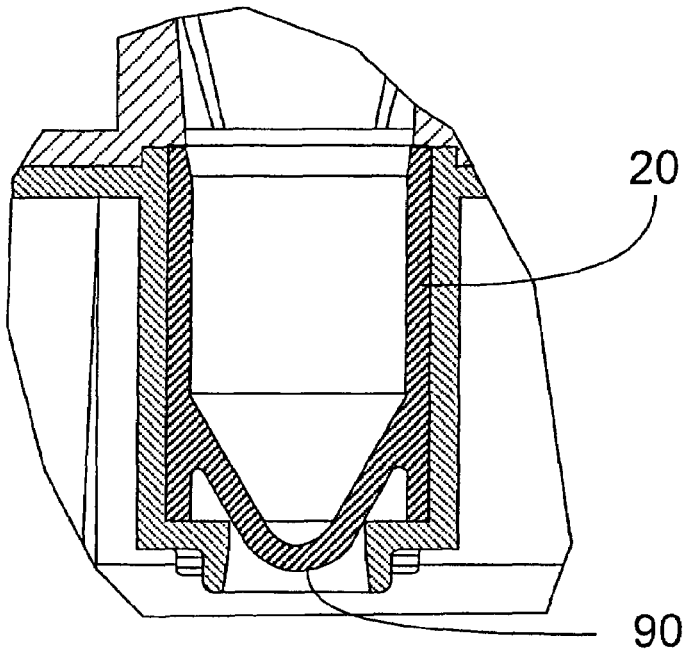
FIG. 11 shows a further embodiment of the present invention in partial cross-sectional view.

In FIG. 11, the insert 20 has a closed bottom 90 and is designed to retain a sample, such as for incubation or reaction. As shown it has a tapered bottom portion that is well known in the art for allowing one to recover a fluid sample quickly and completely. A flat bottomed or round bottom or other bottom design may also be used if desired.

Figure 12:
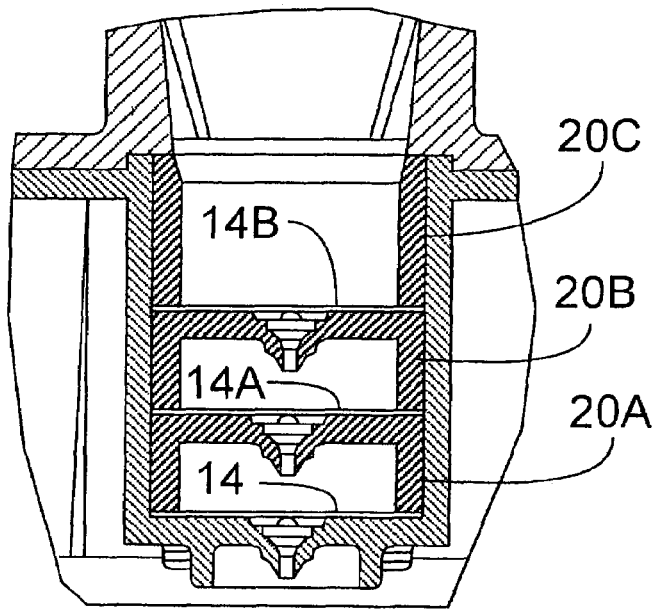
FIG. 12 shows a further embodiment of the present invention in partial cross-sectional view.

FIG. 12 shows an embodiment of a plate according to the present invention. It subdivides the insert into subassemblies 20 A, 20B and 20C. This allows for the use of different layers of filters in a single device. The filters can have different properties such as affinity for certain materials, pore size, charge (positive, negative, neutral) phobicity/philicity and the like. For example, filters of decreasing pore sizes or different filtration characteristics may be in the well 4, and on inserts 20A and 20B. In one example, the filter 14B on 20B may be a prefilter such as a glass fabric of about 5-20 microns average pore diameter. The filter 14A of insert portion 20A may be a microporous filter having a pore size of from about 0.05 micron to about 1 micron and the filter 14 may be an ultrafilter having a nominal molecular cutoff weight of from about 10 kiloDaltons (kD) to about 1000 kD. Alternatively, filter 14B may be of a set pore size, 14A may be charged and 14 may have an affinity ligand attached to its surface. This embodiment allows one to do multiple filtration steps in a single well sequentially on the same sample.

Figure 13:
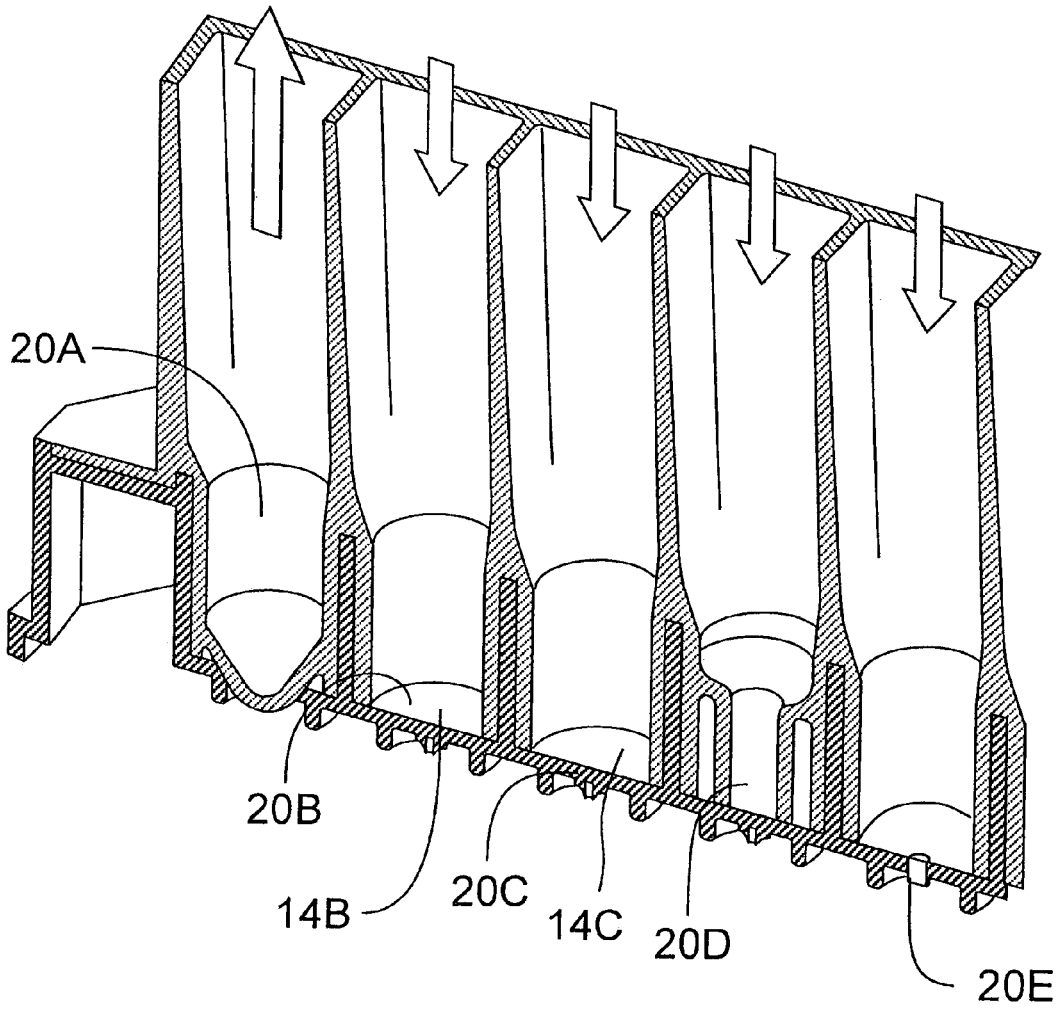
FIG. 13 shows one embodiment of the present invention in partial cross sectional view.

FIG. 13 shows one plate of the present invention. As can be seen each well has a different insert 20 A-E. Insert 20A is a closed bottom insert for storing or incubating the sample. Insert 20B contains a filter 14B such as a microporous filter. Insert 20C may contain a second filter 14C of smaller size. Insert 20 D contains a bed of chromatography media say for capturing proteins and insert 20E contains a cast in place structure for removing endotoxins and the like. In this way, one can form a miniature laboratory in a series of wells in a plate.

The present invention allows one to use one platform and make devices of infinite design by simply selecting the correct insert. The cost involved in designing and manufacturing multiple molds for each plate configuration is eliminated.

The type of membrane suitable for use in this invention is not particularly limited, and may be either an ultrafilter, a microporous filter, or other specialty membranes, such as absorptive particle filled membranes and the like.

Preferred UF filters include regenerated cellulose or polysulfone filters such as YM™ or Biomax™ filters available from Millipore Corporation of Billerica, Mass.

Representative suitable microporous filters include nitrocellulose, cellulose acetate, regenerated cellulose, polysulphones including polyethersulphone and polyarylsulphones, polyvinylidene fluoride, polyolefins such as ultrahigh molecular weight polyethylene, low density polyethylene and polypropylene, nylon and other polyamides, PTFE, thermoplastic fluorinated polymers such as poly (TFE-co-PFAVE), polycarbonates. Such filters are well known in the art and available from a variety of sources, such as DURAPORE® filters, IMMOBILON® filters, ISOPORE™ polycarbonate filters and EXPRESS® filters available from Millipore Corporation of Billerica, Mass.

Specialty or particle filled filters such as EMPORE® filters available from 3M of Minneapolis, Minn., filters that have antibodies, antigens or other interactive materials contained on their surfaces or in their structures may also be used.

The type of prefilter, if used is also not limited in any particular way by the invention and can be any prefilter commonly used in such devices such as glass mats, paper, nonwoven plastics, woven glass or plastic fabrics, paper, plastic or other felts and the like.

Likewise, the plates, inserts and extension plates (if used) may be made from any plastic material used to form such devices. Polyolefins, particularly polypropylene and polyethylene, glass filled polypropylene, polycarbonates, polystyrenes, acrylics, BAREX® resin and the like, with or without fillers such as titanium dioxide to render them opaque are suitable materials for most applications. The selected materials should be capable of allowing a filter to seal to either the plate well surface or the insert surface as discussed above. If a heat seal is used to seal the insert into the well or if an overmold is used to form the extension, then the selected materials for each piece should be compatible with each other to form a good bond between them.

We claim:

1. An assembled multiwell filtration device comprising:

a multiwell filtration plate having a top surface, a bottom surface and two or more filtration plate wells located between the multiwell filtration plate top and bottom surfaces, each filtration plate well having an open top, one or more sidewalls, a bottom surface, a bottom outlet, and an inner bore formed from the one or more sidewalls, a plurality of first liquid permeable filter materials, wherein each of the first liquid permeable filter materials is permanently sealed to the bottom surface of a different filtration plate well, a plurality of inserts, each insert located within the inner bore of a different filtration plate well, between the multiwell filtration plate top and bottom surfaces, positioned adjacent to and in contact with the first liquid permeable filter material each insert having an upper surface, a lower surface, and a through bore having a height substantially the same as the depth of the filtration plate well inner bore, an open top and open bottom, wherein each insert through bore contains one or more of a second liquid permeable material including chromatography media, macroporous structures, frits, sintered glass, sintered plastic, cast in place filters, particle filled filters, nonwoven filters, microporous filters, a sample reservoir, a valve, and combinations thereof, an extension plate located above the multiwell filtration plate sealed to the top surface of the multiwell filtration plate and the upper surface of the inserts, the extension plate includes a series of two or more extension plate wells having an open top and an open bottom, equal in number, corresponding in position, and located above the two or more wells of the multiwell filtration plates and the plurality of inserts.

2. The assembled device of claim 1 wherein each insert through bore is friction fit into separate filtration plate well inner bores.

3. The assembled device of claim 1 wherein the extension plate has been thermally bonded to the top surface of the multiwell filtration plate and to the upper surface of the inserts, and each of the extension plate wells have a height equal to or greater than the height of each of the filtration plate wells.

4. The assembled device of claim 1 wherein the extension plate has been overmolded onto the top surface of the multiwell filtration plates and onto the upper surface of the inserts, and each of the extension plate wells have a height equal to or greater than the height of each of the filtration plate wells.

5. The assembled device of claim 1 wherein the first liquid permeable filter material is selected from the group consisting of ultraporous filters, regenerated cellulose ultraporous filters, polysulfone ultraporous filters, microporous filters, nitrocellulose, cellulose acetate, regenerated cellulose, polysulphones including polyethersulphone and polyarylsulphones, polyvinylidene fluoride, polyolefins, ultrahigh molecular weight polyethylene, low density polyethylene, polypropylene, nylon, polyamides, PTFE, thermoplastic fluorinated polymers, polycarbonates, particle filled filters, glass mat prefilters, paper prefilters, nonwoven plastic prefilters, woven glass prefilters, plastic fabric prefilters, felt prefilters, affinity ligand containing filters, positively charged filters, negatively charred filters, and neutrally charged filters, and is heat-sealed to the bottom surface of the filtration plate well.

6. The assembled device of claim 1 wherein the first liquid permeable filter material is vibration welded to the bottom surface of the filtration plate well.

7. The assembled device of claim 1 wherein the open bottom of the insert through bore is sealed by a third liquid permeable filter material, the insert through bore contains more than one type of chromatography media and the open top of the insert through bore is sealed by a fourth liquid permeable filter material.

8. The assembled device of claim 1 wherein the insert through bore contains more than one type of chromatography media, the top of the insert through bore is sealed by a fourth liquid permeable filter material selected from the group consisting of frits, sintered plastic, sintered glass, particle filled filters, nonwoven filters, ultraporous filters, and microporous filters, and the open bottom of the insert through bore is sealed by a third liquid permeable filter material selected from the group consisting of frits, sintered plastic, sintered glass, particle filled filters, nonwoven filters, ultraporous filters, and microporous filters.

9. An assembled multiwell filtration device comprising:

a multiwell filtration plate having a top surface, a bottom surface, and containing two or more filtration plate wells located between the multiwell filtration plate top and bottom surfaces, each filtration plate well having an open top, a bottom outlet, a bottom surface one or more sidewalls, and an inner bore formed from the one or more sidewalls an insert located within the inner bore of each filtration plate well, said insert having a bottom surface, a shoulder that sits on the top surface of the multiwell filtration plate to limit the travel of the insert into the filtration plate well, the insert through bore having an open top and open bottom, each insert through bore contains one or more of a first fluid permeable material including chromatography media, macroporous structures, frits, sintered glass, sintered plastic, cast in place filters, particle filled filters, nonwoven filters, microporous filters, a sample reservoir, a valve, and combinations thereof, a second fluid permeable filter material permanently sealed to a surface of each insert and is selected from the group consisting of ultraporous filters, regenerated cellulose ultraporous filters, polysulfone ultraporous filters, microporous filters, nitrocellulose, cellulose acetate, regenerated cellulose, polysulphones including polyethersulphone and polyarylsulphones, polyvinylidene fluoride, polyolefins, ultrahigh molecular weight polyethylene, low density polyethylene, polypropylene, nylon, polyamides, PTFE, thermoplastic fluorinated polymers, polycarbonates, particle filled filters, lass mat prefilters, paper prefilters, nonwoven plastic prefilters, woven glass prefilters, plastic fabric prefilters, felt prefilters, affinity ligand containing filters, positively charred filters, negatively charred filters, and neutrally charred filters, and an extension plate located above and sealed onto the top surface of the multiwell filtration plate and onto the shoulder of each insert, wherein the extension plate comprises two or more wells, each extension plate well having an open top and an open bottom, and equal in number, corresponding in position to the filtration plate wells.

10. The assembled device of claim 9 wherein the second fluid permeable filter is permanently sealed to the bottom surface of each insert, and wherein each of the extension plate wells have a height equal to or greater than the height of each of the filtration plate wells.

11. The assembled device of claim 9 further comprising a third fluid permeable filter material permanently sealed to the bottom surface of each filtration plate well, and a fourth fluid permeable filter material sealed over the open top of the insert through bore, wherein the second fluid permeable filter material is permanently sealed to an inner surface of each insert.

12. The assembled device of claim 9 further comprising an additional one or more fluid permeable filters permanently sealed to one or more surfaces of each insert.

13. The assembled device of claim 9 further comprising an additional two or more fluid permeable filters permanently sealed to one or more surfaces of each insert and wherein one of the additional fluid permeable filters has a pore size larger than the pore size of another additional fluid permeable filter below it.

14. The assembled device of claim 1 wherein the second liquid permeable material located in the insert through bore of at least one filtration plate well is different from the second liquid permeable filter material in the other filtration plate wells.

15. The assembled device of claim 1 wherein at least one well has an insert through bore has a closed bottom forming a reservoir for storing or incubating a sample located therein.

16. The assembled device of claim 1 wherein at least one well has an insert through bore contains a valve.

17. The assembled device of claim 1 wherein the two or more filtration plate wells are a series of wells, and the insert located in each filtration plate well is different from the insert located in the other filtration plate wells.

18. The assembled device of claim 1 wherein the two or more filtration plate wells are a series of wells, and the insert positioned in the inner bore of each filtration plate well contains the same or different second liquid permeable, material selected from the group consisting of one or more filters, chromatography media, macroporous structures, a sample reservoir, a valve, a cast in place filter, particle filled filters, nonwoven filters, microporous filters, and combinations thereof.

19. A process of forming a multiwell filtration device comprising:

forming a multiwell filtration plate having a top surface, a bottom surface, and containing two or more wells, each filtration plate well located between the multiwell filtration plate top and bottom surfaces and having one or more sidewalls, an open top, a bottom surface, a bottom outlet, and an inner bore formed from the one or more sidewalls, inserting a first liquid permeable filter into each filtration plate well and sealing the liquid permeable filter to the bottom of each well thereby covering the bottom outlet, with a process selected from the group consisting of heat bonding, vibration welding and adhesive bonding, inserting an insert into the inner bore of each filtration plate well, said insert having a shoulder that sits on the top surface of the multiwell filtration plate to limit the travel of the insert into the filtration plate well, and a through bore having an open top and open bottom, inserting a second liquid permeable material comprising chromatography media, frits, sintered lass, sintered plastic, cast in place filters, particle filled filters, nonwoven filters, microporous filters, a sample reservoir, a valve, and combinations thereof into each insert through bore, attaching an extension plate by adhesive bonding heat sealing, or overmolding onto the top surface of the multiwell filtration plate and onto the upper surface of each insert shoulder, the extension plate including two or more wells having an open top, an open bottom, and equal in number and corresponding in position to the filtration plate wells, wherein each of the extension plate wells have a height equal to or greater than the height of each of the filtration plate wells.

20. A multiwell filtration device comprising:

a multiwell filtration plate comprising a top surface, a bottom surface, and two or more filtration plate wells, each filtration plate well is located between the multiwell filtration plate top surface and bottom surface, and includes, an open top, one or more sidewalls, a bottom surface, an outlet formed at the bottom, and an inner bore formed from the one or more sidewalls, a first liquid permeable filter material sealed to the bottom surface of each filtration plate well, the first liquid permeable filter material is selected from the group consisting of ultraporous filters, regenerated cellulose ultraporous filters, polysulfone ultraporous filters, microporous filters, nitrocellulose, cellulose acetate, regenerated cellulose, polysulphones including polyethersulphone and polyarylsulphones, polyvinvlidene fluoride, polyolefins, ultrahigh molecular weight polyethylene, low density polyethylene, polypropylene, nylon, polyamides, PTFE, thermoplastic fluorinated polymers, polycarbonates, particle filled filters, glass mat prefilters, paper prefilters, nonwoven plastic prefilters, woven glass prefilters, plastic fabric prefilters, felt prefilters, affinity ligand containing filters, positively charged filters, negatively charred filters, and neutrally charged filters, an insert fit into the each filtration plate well inner bore, between the multiwell filtration plate top and bottom surfaces, the insert having an upper surface, a through bore of having a height substantially the same as the depth of the filtration plate well inner bore, an open top an open bottom, and each insert through bore contains a second liquid permeable material comprising one or more of a chromatography media, macroporous structures, frits, sintered glass, sintered plastic, cast in place filters, particle filled filters, nonwoven filters, microporous filters, a sample reservoir, a valve, and combinations thereof, and an extension plate overmolded, heat sealed, or adhered onto the top surface of the multiwell filtration plate and onto the upper surface of each insert, the extension plate comprising two or more extension plate wells, each well having an open top and an open bottom, and equal in number, corresponding in position to, and located above the two or more wells of the filtration plate, wherein each of the extension plate wells have a height equal to or greater than the height of each of the filtration plate wells.

21. The device of claim 20 wherein the open bottom of the insert through bore is sealed by a third liquid permeable material, the open top of the insert through bore is sealed by a fourth liquid permeable material, and the second liquid permeable material is selected from the group consisting of frits, sintered plastic, sintered glass, particle filled filters, nonwoven filters and microporous filters.

22. The device of claim 20 further comprising additional liquid permeable filters permanently sealed to one or more surfaces of each insert and each insert is positioned adjacent to and in contact with the first liquid permeable filter material.

23. The device of claim 20 further comprising additional liquid permeable filters permanently sealed to one or more surfaces of each insert and wherein one of the additional liquid permeable filters has a pore size larger than the pore size of the additional liquid permeable filter below it.

24. The device of claim 20 wherein the first liquid permeable filter material in at least one filtration plate well is different from the first liquid permeable filter material in the other filtration plate wells, and wherein the second liquid permeable material in at least one insert through bore is different from the second liquid permeable filter material in the other insert through bores.

25. The device of claim 20 wherein at least one filtration plate well has an insert that is different from the insert in the other filtration plate wells.

26. The device of claim 20 wherein the insert through bore in at least one filtration plate well contains a valve.

27. The device of claim 20 wherein the insert through bore has a closed bottom forming a reservoir for storing or incubating a sample located therein.

28. The device of claim 20 wherein the two or more filtration plate wells is a series of filtration plate wells, and the insert through bore in each filtration plate well contains the same or different second liquid permeable material comprising one or more of a chromatography media, a sample reservoir, a valve, frits, sintered glass, sintered plastic, a cast in place filter, a media device, a particle filled filter, a nonwoven filter, a microporous filter, and combinations thereof.

29. A process of forming an assembled multiwell filtration device comprising:

a. forming a multiwell filtration plate containing a top surface, a bottom surface, and two or more wells, each filtration plate well is located between the multiwell filtration plate top and bottom surfaces, and includes an open top, one or more sidewalls, a bottom surface, a bottom forming an outlet, and an inner bore formed from the one or more sidewalls, b. inserting a first liquid permeable filter material selected from the group consisting of ultraporous filters, regenerated cellulose ultraporous filters, polysulfone ultraporous filters, microporous filters, nitrocellulose, cellulose acetate, regenerated cellulose, polysulphones including polyethersulphone and polyarylsulphones, polyvinylidene fluoride, polyolefins, ultrahigh molecular weight polyethylene, low density polyethylene, polypropylene, nylon, polyamides, PTFE, thermoplastic fluorinated polymers, polycarbonates, particle filled filters, glass mat prefilters, paper prefilters, nonwoven plastic prefilters, woven glass prefilters, plastic fabric prefilters, felt prefilters, affinity ligand containing filters, positively charged filters, negatively charred filters, and neutrally charred filters into each filtration plate well, c. sealing the first liquid permeable filter material to the bottom surface of each filtration plate well by a process selected from the group consisting of heat bonding, vibration welding and adhesive bonding, d. inserting an insert into the inner bore of each filtration plate well between the multiwell filtration plate top and bottom surfaces, the insert having a top surface, an open top, an open bottom sealed by a second liquid permeable filter material, and a through bore, having a height substantially the same as the depth of the filtration plate well inner bore, contains a third liquid permeable material selected from the group consisting of a chromatography media, macroporous structures, frits, sintered glass, sintered plastic, cast in place filters, particle filled filters, nonwoven filters, microporous filters, a sample reservoir, a valve and combinations thereof, wherein each insert through bore contains the same or different third liquid permeable material, and e. overmolding an extension plate onto the top surface of the multiwell filtration plate and onto the top surface of each insert, the extension plate comprising two or more extension plate wells, each extension plate well having an open top and an open bottom, and equal in number, corresponding in position to, and located above the two or more wells of the filtration plate, wherein each of the extension plate wells have a height equal to or greater than the height of each of the filtration plate wells.

* * * * *

UNITED STATES PATENT AND TRADEMARK OFFICE

CERTIFICATE OF CORRECTION

PATENT NO. : 7,658,886 B2
APPLICATION NO. : 10/838588
DATED : February 9, 2010
INVENTOR(S) : Olivier et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1202 days.

Signed and Sealed this

Thirtieth Day of November, 2010

David J. Kappos

David J. Kappos
*Director of the United States Patent and Trademark Office*